US007456143B2

(12) United States Patent
Speckmann et al.

(10) Patent No.: US 7,456,143 B2
(45) Date of Patent: Nov. 25, 2008

(54) BLEACH-CONTAINING WASHING OR CLEANING AGENTS CONTAINING A SULFATE/SILICATE COATED PERCARBONATE

(75) Inventors: Horst-Dieter Speckmann, Langenfeld (DE); Joerg Poethkow, Neuss (DE); Heike Schirmer-Ditze, Duesseldorf (DE); Gerhard Blasey, Duesseldorf (DE); Birgit Middlehauve, Monheim (DE)

(73) Assignee: Henkel Kommanditgesellschaft auf Aktien (Henkel KGaA), Dusseldorf (DE)

( * ) Notice: Subject to any disclaimer, the term of this patent is extended or adjusted under 35 U.S.C. 154(b) by 0 days.

(21) Appl. No.: 11/159,382

(22) Filed: Jun. 20, 2005

(65) Prior Publication Data

US 2005/0239681 A1 Oct. 27, 2005

Related U.S. Application Data

(63) Continuation of application No. PCT/EP03/13539, filed on Dec. 2, 2003.

(30) Foreign Application Priority Data

Dec. 20, 2002 (DE) ..... 102 61 161
May 7, 2003 (DE) ..... 103 20 196

(51) Int. Cl.
*C11D 3/395* (2006.01)
*C11D 7/12* (2006.01)
*C11D 7/14* (2006.01)

(52) U.S. Cl. ..... 510/349; 510/276; 510/302; 510/309; 510/310; 510/318; 510/361; 510/367; 510/372; 510/375; 510/398; 510/431; 510/434; 510/435; 510/441; 510/460; 510/477; 510/478; 510/509; 510/511; 510/531; 510/533

(58) Field of Classification Search ..... 510/276, 510/302, 309, 310, 318, 349, 361, 367, 372, 510/375, 398, 431, 434, 435, 441, 460, 477, 510/478, 509, 511, 531, 533
See application file for complete search history.

(56) References Cited

U.S. PATENT DOCUMENTS

| | | | | |
|---|---|---|---|---|
| 1,985,424 | A | | 12/1934 | Piggott |
| 2,016,962 | A | | 10/1935 | Flint et al. |
| 2,299,437 | A | | 10/1942 | Benson et al. |
| 2,703,798 | A | | 3/1955 | Schwartz |
| 3,122,417 | A | | 2/1964 | Blaser et al. |
| 3,547,828 | A | | 12/1970 | Mansfield et al. |
| 3,632,957 | A | | 1/1972 | Hannah |
| 3,748,233 | A | | 7/1973 | Viccaro |
| 4,264,738 | A | | 4/1981 | Stepanov et al. |
| 4,325,933 | A | | 4/1982 | Matsumoto et al. |
| 4,372,868 | A | | 2/1983 | Saran et al. |
| 4,443,355 | A | | 4/1984 | Murata et al. |
| 4,526,698 | A | * | 7/1985 | Kuroda et al. ..... 510/305 |
| 5,138,046 | A | | 8/1992 | Wuest et al. |
| 5,219,549 | A | * | 6/1993 | Onda et al. ..... 423/415.2 |
| 5,240,851 | A | | 8/1993 | Paridans et al. |
| 5,259,981 | A | * | 11/1993 | Chapple et al. ..... 510/312 |
| 5,332,518 | A | * | 7/1994 | Kuroda et al. ..... 510/309 |
| 5,374,716 | A | | 12/1994 | Biermann et al. |
| 5,427,936 | A | | 6/1995 | Moeller et al. |
| 5,443,507 | A | | 8/1995 | Jacobi |
| 5,462,804 | A | * | 10/1995 | Kokubu et al. ..... 428/402.24 |
| 5,478,488 | A | * | 12/1995 | Doetsch et al. ..... 510/375 |
| 5,576,425 | A | | 11/1996 | Hill et al. |
| 5,583,098 | A | * | 12/1996 | Boskamp et al. ..... 510/351 |
| 5,700,771 | A | * | 12/1997 | Hardy et al. ..... 510/315 |
| 5,714,201 | A | * | 2/1998 | Bewersdorf et al. ..... 427/213 |
| 5,747,438 | A | * | 5/1998 | MacBeath ..... 510/224 |
| 5,792,738 | A | * | 8/1998 | Baillely et al. ..... 510/375 |
| 5,858,957 | A | * | 1/1999 | Donoghue et al. ..... 510/445 |
| 5,902,682 | A | * | 5/1999 | Bertsch-Frank et al. ..... 428/403 |
| 5,929,015 | A | * | 7/1999 | Lagnemo et al. ..... 510/378 |
| 6,221,824 | B1 | | 4/2001 | Lietzmann et al. |
| 6,239,095 | B1 | | 5/2001 | Bertsch-Frank et al. |
| 6,267,934 | B1 | | 7/2001 | Pardini et al. |
| 6,391,846 | B1 | * | 5/2002 | Berthod et al. ..... 510/507 |
| 6,455,489 | B2 | * | 9/2002 | Bijsterbosch et al. ..... 510/471 |
| 6,465,408 | B1 | * | 10/2002 | Lee et al. ..... 510/349 |
| 6,521,583 | B1 | * | 2/2003 | James et al. ..... 510/375 |
| 6,559,113 | B2 | * | 5/2003 | Jeffrey et al. ..... 510/296 |
| 2001/0014306 | A1 | * | 8/2001 | Horne et al. ..... 423/415.2 |
| 2001/0044398 | A1 | * | 11/2001 | Speckmann et al. ..... 510/305 |
| 2003/0166484 | A1 | | 9/2003 | Kingma et al. |
| 2004/0067862 | A1 | | 4/2004 | Speckmann et al. |
| 2004/0067863 | A1 | | 4/2004 | Speckmann et al. |

FOREIGN PATENT DOCUMENTS

| | | |
|---|---|---|
| CA | 2 053 900 | 10/1990 |
| CA | 2 204 383 | 5/1996 |
| DE | 255 884 | 1/1913 |
| DE | 11 07 207 | 5/1961 |
| DE | 1 940 488 | 2/1971 |
| DE | 2 044 161 | 4/1971 |
| DE | 22 01 803 | 7/1972 |

(Continued)

*Primary Examiner*—Charles I Boyer
(74) *Attorney, Agent, or Firm*—John S. Child, Jr.

(57) ABSTRACT

A particulate washing or cleaning composition containing (A) a phosphate-free water-soluble builder component and (B) alkali metal percarbonate particles having a coating containing alkali metal silicate.

21 Claims, No Drawings

FOREIGN PATENT DOCUMENTS

| | | | |
|---|---|---|---|
| DE | 21 21 397 | | 11/1972 |
| DE | 26 22 610 | A1 | 12/1976 |
| DE | 31.17 250 | A1 | 4/1982 |
| DE | 32 07 825 | A1 | 9/1982 |
| DE | 32 07 847 | A1 | 9/1982 |
| DE | 33 22 950 | A1 | 1/1984 |
| EP | 0 092 355 | A1 | 10/1983 |
| EP | 0 066 638 | B1 | 4/1984 |
| EP | 0 117 553 | A2 | 9/1984 |
| EP | 0 037 026 | B1 | 7/1985 |
| EP | 0 204 284 | A2 | 12/1986 |
| EP | 0 130 064 | B1 | 8/1988 |
| EP | 0 362 671 | A1 | 4/1990 |
| EP | 0 214 761 | B1 | 5/1990 |
| EP | 0 384 717 | A1 | 8/1990 |
| EP | 0 385 401 | A1 | 9/1990 |
| EP | 0 218 272 | B1 | 3/1992 |
| EP | 0 357 969 | B1 | 9/1992 |
| EP | 0 167 309 | B1 | 10/1992 |
| EP | 0 273 125 | B1 | 3/1993 |
| EP | 0 301 298 | B1 | 3/1993 |
| EP | 0 330 641 | B1 | 7/1993 |
| EP | 0 265 832 | B1 | 10/1993 |
| EP | 0 269 977 | B1 | 6/1994 |
| EP | 0 258 068 | B1 | 8/1994 |
| EP | 0 341 947 | B1 | 8/1994 |
| EP | 0 623 533 | A1 | 11/1994 |
| EP | 0 339 550 | B1 | 3/1995 |
| EP | 0 270 974 | B1 | 4/1995 |
| EP | 0 305 216 | B1 | 8/1995 |
| EP | 0 468 102 | B1 | 12/1995 |
| EP | 0 375 102 | B1 | 4/1996 |
| EP | 0 331 376 | B1 | 10/1997 |
| EP | 0 703 190 | B1 | 1/2000 |
| EP | 0 992 575 | A1 | 4/2000 |
| EP | 0 334 462 | B2 | 4/2002 |
| EP | 0 922 575 | B1 | 4/2002 |
| GB | 174 891 | | 1/1922 |
| GB | 1 263 765 | | 2/1972 |
| GB | 1 538 893 | | 12/1976 |
| GB | 2 094 826 | A | 9/1982 |
| GB | 2 095 275 | A | 9/1982 |
| WO | WO 90/10695 | A1 | 9/1990 |
| WO | WO 90/13533 | A1 | 11/1990 |
| WO | WO 91/02792 | A1 | 3/1991 |
| WO | WO 91/16422 | A1 | 10/1991 |
| WO | WO 92/06984 | A1 | 4/1992 |
| WO | WO 95/02555 | A1 | 1/1995 |
| WO | WO 95/02675 | A1 | 1/1995 |
| WO | WO 96/06615 | A1 | 3/1996 |
| WO | WO 96/14388 | A1 | 5/1996 |
| WO | WO 96/22354 | A1 | 7/1996 |
| WO | WO 97/14804 | A1 | 4/1997 |
| WO | WO 97/19890 | A1 | 6/1997 |
| WO | WO 97/45524 | A1 | 12/1997 |
| WO | WO 00/50553 | A1 | 8/2000 |
| WO | WO 00/50556 | A1 | 8/2000 |
| WO | WO 02/12425 | A1 | 2/2002 |
| WO | WO 02/12426 | A1 | 2/2002 |
| WO | WO 02/26927 | A1 | 4/2002 |

* cited by examiner

BLEACH-CONTAINING WASHING OR CLEANING AGENTS CONTAINING A SULFATE/SILICATE COATED PERCARBONATE

CROSS REFERENCE TO RELATED APPLICATIONS

This application is a continuation under 35 U.S.C. § 365(c) and 35 U.S.C. § 120 of international application PCT/EP2003/013539, filed Dec. 2, 2003. This application also claims priority under 35 U.S.C. § 119 of DE 102 61 161.0, filed Dec. 20, 2002 and DE 103 20 196.3, filed May 7, 2003, each of which is incorporated herein by reference in its entirety.

BACKGROUND OF THE INVENTION

This invention relates to particulate detergent or cleaning compositions that comprise only water-soluble constituents as their builder component and that contain specially coated alkali metal percarbonate particles.

Besides the surfactants essential to their detersive performance, detergents normally also contain so-called builders that support the performance of the surfactants by eliminating hardness salts, i.e. essentially calcium and magnesium ions, from the wash liquor, so that they do not interact negatively with the surfactants. Originally, polyphosphates, especially sodium triphosphate, were very successfully used for this purpose but, in view of their eutrophicating effect in water bodies, have not been able to be used at all, or only conditionally, for decades now. Another known example of builders which improve single-cycle washing performance is zeolite Na-A, which is known to be capable of forming such stable complexes with calcium ions in particular that their reaction with anions responsible for water hardness, particularly carbonate, to form insoluble compounds is suppressed. In addition, builders—particularly in laundry detergents—are supposed to prevent redeposition both of the soil detached from the fibers or generally from the surface to be cleaned and of insoluble compounds formed by reaction of cations responsible for water hardness with anions responsible for water hardness onto the cleaned fabric or surface. So-called co-builders, generally polymeric polycarboxylates, are normally used for this purpose. Besides their contribution to multiple-cycle washing performance, co-builders advantageously have a complexing effect towards the cations responsible for water hardness.

Besides the indispensable active components mentioned, such as surfactants and builders, detergents generally contain other components that are known collectively as washing aids and that encompass such diverse groups as foam regulators, redeposition inhibitors, bleaching agents, enzymes and dye transfer inhibitors. Particular importance is attributed to the bleaching agents, above all with regard to the boosting of washing or cleaning performance against a range of different soils. Auxiliaries such as these include substances that, in laundry detergents, support surfactant performance through the oxidative degradation of soils present on the fabric or soils present in the wash liquor after detachment from the fabric. The same also applies correspondingly to cleaning preparations for hard surfaces. Thus, inorganic peroxygen compounds, particularly hydrogen peroxide, and solid peroxygen compounds, which dissolve in water with release of hydogen peroxide or so-called active oxygen, such as sodium perborate and sodium carbonate perhydrate, have long been used as oxidizing agents for disinfection and bleaching purposes.

Sodium carbonate perhydrate, which is often referred to in short as sodium percarbonate, is the addition compound of hydrogen peroxide onto sodium carbonate (empirical formula 2 $Na_2CO_3$—3 $H_2O_2$). The carbonate salts of the other alkali metals also form $H_2O_2$ addition compounds. In view of its often unsatisfactory storage stability in humid environments and in the presence of other typical detergent ingredients, particularly silicate-containing builders, the alkali metal percarbonate normally has to be stabilized against the loss of active oxygen. A key principle for stabilization is to provide the alkali metal percarbonate particles with a coating that may comprise one or more layers. Each coating layer may contain one or more inorganic and/or organic coating components.

Besides increasing storage stability, the presence of a coating generally alters the dissolving characteristics of the alkali metal percarbonate. For example, the high solubility of uncoated alkali metal percarbonates in water can have an adverse effect where they are present in enzyme-containing detergents/cleaning compositions, because relatively high concentrations of active oxygen are available just after the beginning of the washing or cleaning process and can impair the effect of a number of enzymes, including proteases. This impairment need not necessarily be attributed to the oxidative degradation ("denaturing") of the enzyme, but may also arise from the fact that some soils (for example blood)—as substrates actually to be removed by the enzyme—are converted by the effect of the bleaching agent into a form which is less easy for the enzyme to attack. Accordingly, the object of coating the alkali metal percarbonate is to delay the release of the active oxygen.

Waterglass is known as a coating material for peroxygen compounds, particularly sodium perborate, from British Patent GB 174 891, according to which it is sprayed on as an aqueous solution and then dried for the purpose of increasing active oxygen stability. Waterglass, i.e. a mixture of alkali metal silicates, is also a coating component in Comparison Examples in the process according to German patent application DE 26 22 610. Here, a waterglass solution with a modulus (molar $SiO_2$:$Na_2O$ ratio) of 3.3 is used. However, where thick coating layers are applied, the stabilizing effect is not good enough when percarbonate particles thus coated are stored in a phosphate-containing detergent powder, so that the document in question recommends the application of a combination of sodium carbonate, sodium sulfate and sodium silicate to the peroxo salt to be stabilized. According to U.S. Pat. No. 4,325,933, magnesium sulfate is also a suitable coating component. However, as is apparent from International patent application WO 95/02555 and European patent application EP 0 623 533, magnesium sulfate as sole coating component does not meet the necessary stability requirements. Accordingly, in addition to magnesium sulfate or a magnesium carboxylate, the coating of the alkali metal percarbonate particles described in those documents contains a salt from the group consisting of alkali metal carbonates, hydrogen carbonates and sulfates and, as a third component, an alkali metal silicate, the coating components mentioned being accommodated in one or more layers. It follows from European patent application EP 0 623 533 that the dissolving rate of coated sodium percarbonate particles decreases with increasing quantities of sodium silicate. International patent application WO 97/19890 teaches that sodium percarbonate with a single coating layer of essentially sodium sulfate has sufficient active oxygen stability at least when the sodium percarbonate core material is produced by fluidized-bed spray granulation. However, the dense particle structure only leads to a slightly lower dissolving rate of the sodium percarbonate.

European patent application EP 0 922 575 teaches the possibility of extending the dissolving time of sodium percarbonate through the presence of alkali metal silicate. Quantities of 0.5% by weight to 30% by weight of alkali metal silicate with a modulus of >3 and <5 are either mixed with sodium percarbonate or are applied thereto in the form of a coating layer. For example, the coating layer consists of 9% by weight sodium silicate. In addition, to improve active oxygen stability, special carboxylic acids or hydroxycarboxylic acids may be accommodated in one or more coating layers. Other known stabilizers from the group consisting of magnesium sulfate, sodium sulfate, sodium carbonate and sodium hydrogen carbonate may additionally be present in the coating layer. The sodium percarbonate particles thus coated are used in combination with enzymes above all for washing laundry or for dishwashing, although only preparations containing zeolite or sodium tripolyphosphate are actually disclosed.

Similarly, in the detergents according to International patent application WO 97/45524, which contain a cationic ester surfactant and an alkalinity system, which may even be sodium percarbonate, it is important that the alkalinity system is released slowly in water. A preferred coating for the slow release of sodium carbonate is said to be a coating containing sodium silicate with a modulus of 1.6 to 3.4 and, more particularly, 2.8. The sodium silicate may be replaced by magnesium silicate. The sodium percarbonate particles thus coated, which are described as slow-release particles, are used—partly together with sodium perborate—in preparations containing zeolite and/or sodium tripolyphosphate.

International patent application WO 96/22354 also describes detergents which contain sodium percarbonate particles coated with a combination of sodium carbonate, magnesium sulfate and sodium silicate. These particles dissolve in water more slowly than the detergent as a whole. They are used in zeolite-containing detergents.

It has now surprisingly been found that the bleaching effect of alkali metal percarbonate particles coated with a layer containing alkali metal silicate is developed particularly well if these alkali metal percarbonate particles are used in detergent or cleaning compositions that are free from water-insoluble builder, i.e. contain only water-soluble builder, phosphate builders being ruled out for ecological reasons, as mentioned above.

DESCRIPTION OF THE INVENTION

Accordingly, the present invention relates to a particulate bleach- and builder-containing detergent or cleaning composition containing (A) a phosphate-free water-soluble builder component and (B) alkali metal percarbonate particles provided with a coating layer containing alkali metal silicate.

In addition to the builder component and the alkali metal percarbonate, the composition may contain any other ingredients typically encountered in detergent or cleaning compositions providing they do not negatively interact with any of those ingredients in an unreasonable manner. However, the use of the expression "builder component" is intended to signify the totality of builders present in the compositions, which contain no other builders than those which are soluble in water and phosphate-free, i.e. all the builders present in the composition are combined in the "component" thus characterized, except for the small quantities of materials which are normally present as impurities or stabilizing additives in the other ingredients of the compositions. Preferred compositions according to the invention also contain no other bleaching agent than the coated alkali metal percarbonate mentioned, although they may do so, if desired. In preferred compositions, the percentage content of alkali metal percarbonate particles is in the range from 6% by weight to 30% by weight and more particularly in the range from 10% by weight to 25% by weight.

Both here and elsewhere in the present specification, sodium is the preferred alkali metal, although lithium, potassium and rubidium salts may also be used, if desired.

The coated alkali metal percarbonate particles present in the compositions according to the invention have an alkali metal percarbonate core which can have been produced by any process and may also contain stabilizers known per se, such as magnesium salts, silicates and phosphates. The production processes typically used in practice are, in particular, so-called crystallization processes and fluidized-bed spray granulation processes. In the crystallization process, hydrogen peroxide and alkali metal carbonate are reacted in water to form alkali metal percarbonate which, after crystallization, is separated from the aqueous mother liquor. Whereas, in earlier processes, alkali metal percarbonate was crystallized out in the presence of a relatively high concentration of an inert salt, such as sodium chloride, processes in which crystallization can take place in the absence of a salting-out agent are now also known, cf. European patent application EP 0 703 190. In fluidized-bed spray granulation, an aqueous hydrogen peroxide solution and an aqueous alkali metal carbonate solution are sprayed onto alkali metal carbonate nuclei in a fluidized bed and, at the same time, water is evaporated. The granules developing in the fluidized bed are removed therefrom as a whole or after sizing. Examples of such a production process can be found in International patent application WO 96/06615. Finally, alkali metal percarbonate produced by a process comprising contacting solid alkali metal carbonate or a hydrate thereof with an aqueous hydrogen peroxide solution and drying may also form the core of the alkali metal percarbonate particles.

The alkali metal percarbonate particle present in the compositions according to the invention preferably comprises at least two coating layers, an innermost layer containing at least one hydrate-forming inorganic salt and an outer layer containing alkali metal silicate. The outer coating layer containing alkali metal silicate may either be the outermost coating layer of a coating comprising at least two layers or a coating layer which is not the innermost layer in direct contact with the alkali metal percarbonate and which in turn may be covered by one or more layers. Although individual layers are mentioned both in the present specification and in the prior art, it is pointed out that the constituents of the vertically adjacent layers may merge into one another, at least in the boundary region. This at least partial penetration results from the fact that, in the coating of alkali metal percarbonate particles having an innermost coating layer, this innermost coating layer is partly dissolved—superficially at least—when a solution containing a coating component or the coating components of a second coating layer is sprayed on.

The alkali metal percarbonate may be coated in known manner. In principle, the particles to be coated are uniformly contacted one or more times with a solution containing one or more coating components and simultaneously or subsequently dried. For example, contacting may be carried out in a pan granulator or in a mixer, such as a tumble mixer. In a particularly advantageous embodiment, coating is carried out by fluidized bed coating, a first solution containing the coating component(s) for forming an innermost layer and then a second solution containing the coating component(s) for forming the outer layer being sprayed onto the alkali metal percarbonate in the fluidized bed or onto the alkali metal percarbonate coated with one or more layers and being simultaneously dried with the fluidizing gas. The fluidizing gas may be any gas, more particularly air, air with a $CO_2$ content of, for example, 0.1 to ca. 15% directly heated with a combustion gas, pure $CO_2$, nitrogen and inert gases.

The coated alkali metal percarbonate preferably used in compositions according to the invention contains at least one inorganic salt capable of hydrate formation in the innermost coating layer. In addition to this, the innermost coating layer may also contain other stabilizing inorganic salts and/or organic compounds, such as alkalil metal salts of carboxylic acids or hydroxycarboxylic acids. In a particularly preferred embodiment, the innermost coating layer contains one or more salts from the group consisting of alkali metal sulfates, alkali metal carbonates, alkali metal hydrogen carbonates, alkali metal borates and alkali metal perborates. In an alternative embodiment, the innermost coating layer may also contain magnesium sulfate either on its own or in admixture with one or more of the above-mentioned salts. In a particularly preferred embodiment, the innermost coating layer consists essentially of alkali metal sulfate which may also be partly present in hydrated form. By "essentially" is meant that alkali metal hydrogen carbonate or a double salt of alkali metal hydrogen carbonate, such as sesquicarbonate or Wegscheider's salt, may also be present at least in the boundary layer between the alkali metal percarbonate core and the innermost layer. The innermost layer of the coated particle preferably makes up 2% by weight to 20% by weight, more preferably 3% by weight to 10% by weight and most preferably 4% by weight to 8% by weight, based on the coated alkali metal percarbonate. The quantity of coating mentioned relates to the coating in hydrate-free form. The quantity of coating can increase through hydrate formation as a result of storage in a damp atmosphere.

The coating layer containing the alkali metal silicate, which may be directly applied to the alkali metal percarbonate core, but is preferably arranged as an outer layer and more particularly as a second layer on the innermost coating layer mentioned above preferably makes up 0.2% by weight to 3% by weight, more particularly 0.3% by weight to less than 1% by weight of the coated particle. A further reduction in the quantity of alkali metal silicate is possible in principle although, in that case, the effect which increases the dissolving time is weaker. Similarly, an increase in the quantity of alkali metal silicate is possible where a particularly long dissolving time is required. The alkali metal silicate preferably has a modulus of >2.5, more preferably in the range from 3 to 5 and most preferably in the range from 3.2 to 4.2. The modulus is the molar $SiO_2$ to $M_2O$ ratio, where M is the alkali metal. In a preferred embodiment, an aqueous solution containing alkali metal silicate in a concentration of 2% by weight to 20% by weight, preferably 3% by weight to 15% by weight and more particularly 5% by weight to 10% by weight is used for the production of the coating layer containing alkali metal silicate.

Another key feature of compositions according to the invention is that they contain a water-soluble builder component. By "water-soluble" is meant that at least 3 g/l and more particularly at least 6 g/l of the builder component dissolves completely in water with a pH of 7 at room temperature. The builder component is preferably completely soluble at the concentration established through the quantity in which the detergent containing it is used under typical washing conditions.

The compositions according to the invention preferably contain at least 15% by weight and up to 55% by weight and, more particularly, 25% by weight to 50% by weight of water-soluble builder component. The builder component is preferably composed of the following components:

a) 5% by weight to 35% by weight citric acid, alkali metal citrate and/or alkali metal carbonate which may also be at least partly replaced by alkali metal hydrogen carbonate,
b) up to 10% by weight alkali metal silicate with a modulus of 1.8 to 2.5,
c) up to 2% by weight phosphonic acid and/or alkali metal phosphonate and
d) up to 10% by weight polymeric polycarboxylate, the quantities mentioned being based on the detergent or cleaning composition as a whole. The same also applies to all quantities mentioned in the following, unless otherwise specifically indicated.

In a preferred embodiment of compositions according to the invention, the phosphate-free water-soluble builder component contains at least two of components b), c) and d) in quantities of more than 0% by weight.

With regard to component a), a preferred embodiment of compositions according to the invention contains 15% by weight to 25% by weight of alkali metal carbonate, which may be at least partly replaced by alkali metal hydrogen carbonate, and up to 5% by weight and more particularly 0.5% by weight to 2.5% by weight citric acid and/or alkali metal citrate. An alternative embodiment of compositions according to the invention contains as component a) 5% by weight to 25% by weight and more particularly 5% by weight to 15% by weight citric acid and/or alkali metal citrate and up to 5% by weight and more particularly 1% by weight to 5% by weight alkali metal carbonate which may be at least partly replaced by alkali metal hydrogen carbonate. If both alkali metal carbonate and alkali metal hydrogen carbonate are present, component a) contains alkali metal carbonate and alkali metal hydrogen carbonate in a ratio by weight of preferably 10:1 to 1:1.

With regard to component b), a preferred embodiment of compositions according to the invention contains 1% by weight to 5% by weight alkali metal silicate with a modulus of 1.8 to 2.5

With regard to component c), a preferred embodiment of compositions according to the invention contains 0.05% by weight to 1% by weight phosphonic acid and/or alkali metal phosphonate. Phosphonic acids in the present context are also understood to include optionally substituted alkyl phosphonic acids which may also contain several phosphonic acid groups (so-called polyphosphonic acids). They are preferably selected from hydroxy and/or aminoalkyl phosphonic acids and/or alkali metal salts thereof, such as for example dimethylaminomethane diphosphonic acid, 3-aminopropane-1-hydroxy-1,1-diphosphonic acid, 1-amino-1-phenylmethane diphosphonic acid, 1-hydroxyethane-1,1-diphosphonic acid, amino-tris(methylenephosphonic acid), N,N,N',N'-ethylenediamine tetrakis-(methylenephosphonic acid) and the acylated derivatives of phosphorous acid described in DE-AS 11 07 207, which may also be used in the form of mixtures.

With regard to component d), a preferred embodiment of compositions according to the invention contains 1.5% by weight to 5% by weight polymeric polycarboxylate selected in particular from the polymerization or copolymerization products of acrylic acid, methacrylic acid and/or maleic acid. Of these, the homopolymers of acrylic acid are particularly preferred, those with an average molecular weight of 5,000 D to 15,000 D (PA standard) being most particularly preferred.

The bleach activator component additionally present in preferred embodiments of compositions according to the invention comprises the N— or O-acyl compounds typically used, for example polyacylated alkylenediamines, more particularly tetraacetyl ethylenediamine, acylated glycol urils, more particularly tetraacetyl glycoluril, N-acylated hydantoins, hydrazides, triazoles, urazoles, diketopiperazines, sulfurylamides and cyanurates, also carboxylic anhydrides, more particularly phthalic anhydride, carboxylic acid esters, more particularly sodium nonanoyl and isononanoyl phenol sulfonate, and acylated sugar derivatives, more particularly pentaacetyl glucose, and cationic nitrile derivatives, such as trimethyl ammonium acetonitrile salts. To avoid interaction with the peroxygen compound during storage, the bleach activators can have been coated with coating substances or granulated in known manner, tetraacetyl ethylenediamine with mean particle sizes of 0.01 mm to 0.8 mm granulated with carboxymethyl cellulose, which can be produced, for example, by the process described in European patent EP 37 026, granulated 1,5-diacetyl-2,4-dioxohexahydro-1,3,5-triazine, which can be produced by the process described in German patent DD 255 884, and/or trialkyl ammonium acetonitrile produced in particle form by the processes described in International patent applications WO 00/50553, WO 00/50556, WO 02/12425, WO 02/12426 or WO 02/26927 being particularly preferred. The compositions according to the invention preferably contain such bleach activators in quantities of up to 8% by weight and more particularly in quantities of 2% by weight to 6% by weight, based on the composition as a whole.

In a preferred embodiment, a detergent according to the invention contains nonionic surfactant selected from fatty alkyl polyglycosides, fatty alkyl polyalkoxylates, more particularly ethoxylates and/or propoxylates, fatty acid polyhydroxyamides and/or ethoxylation and/or propoxylation products of fatty alkylamines, vicinal diols, fatty acid alkyl esters and/or fatty acid amides and mixtures thereof, more particularly in a quantity of 2% by weight to 25% by weight.

Suitable nonionic surfactants are the alkoxylates, more particularly the ethoxylates and/or propoxylates, of saturated or mono- to polyunsaturated linear or branched alcohols containing 10 to 22 carbon atoms and preferably 12 to 18 carbon atoms. The degree of alkoxylation of the alcohols is generally between 1 and 20 and preferably between 3 and 10. They may be produced in known manner by reaction of the corresponding alcohols with the corresponding alkylene oxides. Fatty alcohol derivatives are particularly suitable, although branched-chain isomers thereof, more particularly so-called oxoalcohols, may also be used for the production of useful alkoxylates. Accordingly, the alkoxylates and, in particular, the ethoxylates of primary alcohols with linear radicals, more particularly dodecyl, tetradecyl, hexadecyl or octadecyl radicals, and mixtures thereof are suitable. Corresponding alkoxylation products of alkylamines, vicinal diols and carboxylic acid amides, which correspond to the alcohols mentioned in regard to the alkyl moiety, may also be used. Also suitable are the ethylene oxide and/or propylene oxide insertion products of fatty acid alkyl esters, which may be produced by the process described in International patent application WO 90/13533, and the fatty acid polyhydroxyamides obtainable by the processes according to U.S. Pat. Nos. 1,985,424, 2,016,962 and 2,703,798 and International patent application WO 92/06984. Alkyl polyglycosides suitable for incorporation in the detergents according to the invention are compounds corresponding to the general formula $(G)_n$-$OR^{12}$, where $R^{12}$ is an alkyl or alkenyl group containing 8 to 22 carbon atoms, G is a glycose unit and n is a number of 1 to 10. Compounds such as these and their production are described, for example, in European patent applications EP 92 355, EP 301 298, EP 357 969 and EP 362 671 and in U.S. Pat. No. 3,547,828. The glycoside component $(G)_n$ is an oligomer or polymer of naturally occurring aldose or ketose monomers, including in particular glucose, mannose, fructose, galactose, talose, gulose, altrose, allose, idose, ribose, arabinose, xylose and lyxose. The oligomers consisting of these glycosidically linked monomers are characterized not only by the type of sugars present in them, but also by the number of sugars present, the so-called degree of oligomerization. As an analytically determined quantity, the degree of oligomerization n is generally a broken number with a value of 1 to 10 and, in the case of the glycosides preferably used, below 1.5 and, more particularly, between 1.2 and 1.4. By virtue of its ready availability, glucose is the preferred monomer unit. The alkyl or alkenyl moiety R of the glycosides also preferably emanates from readily available derivatives of renewable raw materials, more particularly from fatty alcohols, although branched-chain isomers thereof, particularly so-called oxoalcohols, may also be used for the production of useful glycosides. Accordingly, primary alcohols containing linear octyl, decyl, dodecyl, tetradecyl, hexadecyl or octadecyl radicals and mixtures thereof are particularly suitable. Particularly preferred alkyl glycosides contain a cocofatty alkyl group, i.e. mixtures with—essentially—$R^{12}$=dodecyl and $R^{12}$=tetradecyl.

Instead of or in addition to these surfactants, the compositions may contain other nonionic, zwitterionic, cationic or anionic surfactants, preferably synthetic anionic surfactants of the sulfate or sulfonate type, such as for example alkyl benzenesulfonates, in quantities of preferably not more than 20% by weight and, more particularly, in quantities of 0.1% by weight to 18% by weight, based on the composition as a whole. Synthetic anionic surfactants particularly suitable for use in the compositions are $C_{8-22}$ alkyl and/or alkenyl sulfates containing an alkali metal, ammonium or alkyl- or hydroxyalkyl-substituted ammonium ion as counter-cation. Derivatives of fatty alcohols containing in particular 12 to 18 carbon atoms and branched-chain analogs thereof, so-called oxoalcohols, are preferred. The alkyl and alkenyl sulfates may be produced in known manner by reaction of the corresponding alcohol component with a typical sulfating agent, more particularly sulfur trioxide or chlorosulfonic acid, and subsequent neutralization with alkali metal, ammonium or alkyl- or hydroxyalkyl-substituted ammonium bases. Suitable surfactants of the sulfate type also include sulfated alkoxylation products of the alcohols mentioned, so-called ether sulfates. Ether sulfates preferably contain 2 to 30 and, more particularly, 4 to 10 ethylene glycol groups per molecule. Suitable anionic surfactants of the sulfonate type include the α-sulfoesters obtainable by reaction of fatty acid esters with sulfur trioxide and subsequent neutralization, more particularly the sulfonation products derived from fatty acids containing 8 to 22 and preferably 12 to 18 carbon atoms and linear alcohols containing 1 to 6 and preferably 1 to 4 carbon atoms, and the sulfofatty acids obtainable therefrom by formal saponification. Another preferred embodiment of such compositions includes the presence of synthetic anionic surfactant of the sulfate and/or sulfonate type, more particularly fatty alkyl sulfate, fatty alkyl ether sulfate, sulfofatty acid esters and/or sulfofatty acid disalts, more particularly in a quantity of 2% by weight to 25% by weight. The anionic surfactant is preferably selected from the alkyl or alkenyl sulfates and/or alkyl or alkenyl ether sulfates in which the alkyl or alkenyl group contains 8 to 22 and more particularly 12 to 18 carbon atoms. These anionic surfactants are not normally individual substances, but rather cuts or mixtures, of which those containing more than 20% by weight of compounds containing relatively long-chain ($C_{16-18}$) radicals are preferred.

Other optional surface-active ingredients are soaps, saturated fatty acid soaps, such as the salts of lauric acid, myristic acid, palmitic acid or stearic acid, and soaps derived from natural fatty acid mixtures, for example coconut oil fatty acid, palm kernel oil fatty acid or tallow fatty acid, being suitable. Soap mixtures of which 50% by weight to 100% by weight consist of saturated $C_{12-18}$ fatty acid soaps and up to 50% by weight of oleic acid soap are particularly preferred. Soap is preferably present in quantities of 0.1% by weight to 10% by weight and more particularly in quantities of 0.5% by weight to 5% by weight.

Enzymes optionally present in compositions according to the invention are preferably selected from the group consisting of protease, amylase, lipase, cellulase, hemicellulase, oxidase, peroxidase and mixtures thereof. Protease obtained from microorganisms, such as bacteria or fungi, is particularly suitable. Like the other enzymes, it may be obtained by known fermentation processes from suitable microorganisms which are described, for example, in DE-OSS 19 40 488, 20 44 161, 22 01 803 and 21 21 397, in U.S. Pat. Nos. 3,632,957 and 4,264,738, in European patent application EP 006 638 and in International patent application WO 91/02792. Proteases are commercially available, for example, under the names of BLAP®, Savinase®, Esperase®, Maxatase®, Optimase®, Alcalase®, Durazym® or Maxapem®. The lipase suitable for use in accordance with the invention may be obtained from *Humicola lanuginosa*, as described for example in European patent applications EP 258 068, EP 305 216 and EP 0 341 947, from *bacillus* species, as described for example in International patent application WO 91/16422 or European patent application EP 0 384 717, from *pseudomonas* species, as described for example in European patent applications EP 468 102, EP 385 401, EP 375 102, EP 334 462, EP 331 376, EP 330 641, EP 214 761, EP 218 272 or EP 204 284 or in International patent application WO 90/10695, from *fusarium* species, as described for example in European patent application EP 130 064, from *rhizopus* species, as described for example in European patent application EP 117 553, or from *aspergillus* species, as described for example in European patent application EP 167 309. Suitable lipases are commercially available, for example, under the names of Lipolase®, Lipozym®, Lipomax, Amano® Lipase, Toyo Jozo® Lipase, Meito® Lipase and Diosynth® Lipase. Suitable amylases are commercially obtainable, for example, under the names of Maxamyl®, Termamyl® and Purafect® OxAm. The cellulase used may be an enzyme obtainable from bacteria or fungi which has an optimum pH preferably in the mildly acidic to mildly alkaline range of 6 to 9.5. Such cellulases are known, for example, from DE-OSS 31 17 250, DE 32 07 825, DE 32 07 847, DE 33 22 950, from European patent applications EP 265 832, EP 269 977, EP 270 974, EP 273 125 and EP 0 339 550 and from International patent applications WO 95/02675 and WO 97/14804 and are commercially obtainable under the names of Celluzyme®, Carezyme® and Ecostone®.

As used herein, and in particular as used herein to define the elements of the claims that follow, the articles "a" and "an" are synonymous and used interchangeably with "at least one" or "one or more," disclosing or encompassing both the singular and the plural, unless specifically defined otherwise. The conjunction "or" is used herein in its inclusive disjunctive sense, such that phrases formed by terms conjoined by "or" disclose or encompass each term alone as well as any combination of terms so conjoined, unless specifically defined otherwise. All numerical quantities are understood to be modified by the word "about," unless specifically modified otherwise or unless an exact amount is needed to define the invention over the prior art.

EXAMPLES

Example 1

Production of the Alkali Metal Percarbonate Particles

In a pilot-scale plant, commercially available sodium percarbonate coated with 6% by weight sodium sulfate (quality 30 and 35 of Degussa AG) was coated on a 150 kg scale using a 10% by weight sodium waterglass solution with a modulus of 3.2. Coating was carried out by the process according to U.S. Pat. No. 6,239,095. The quantity (in % by weight) of sodium silicate used for coating, the particle spectrum and the dissolving times (in minutes; 2 g product per liter water, 15° C., 95% dissolution as determined by conductometry) are shown in Table 1 below.

TABLE 1

| No. | Quality | Quantity used for coating | Dissolving time | $D_{50}$ (mm) | $D_{10}$ (mm) | $D_{90}$ (mm) |
|---|---|---|---|---|---|---|
| PC1 | Q 30 | 0.75 | 13.0 | 0.55 | 0.35 | 0.90 |
| PC2 | Q 35 | 0.50 | 14.5 | 0.87 | 0.55 | 1.25 |
| PC3 | Q 35 | 0.75 | 21.5 | 0.78 | 0.50 | 1.20 |

Example 2

Washing Tests

The sodium percarbonate particles PC1, PC2 and PC3 produced in accordance with Example 1 were incorporated in a quantity of 13% by weight in an otherwise typically formulated particulate detergent which additionally contained 15% by weight surfactant, 0.75% by weight enzyme mixture (protease/amylase/cellulase) and 3.5% by weight tetraacetyl ethylenediamine and—as builder component—20.5% by weight sodium carbonate, 5% by weight sodium hydrogen carbonate, 1% by weight citric acid, 0.74% by weight hydroxyethane-1,1-diphosphonic acid tetrasodium salt and 3% by weight sodium polyacrylate. Detergents which had otherwise the same composition, but which contained the sodium percarbonate qualities Q 30 and Q 35 coated only with sodium sulfate used as starting material in Example 1, were also produced for comparison. Detergents which contained 13% by weight PC1, PC2 or PC3 and also corresponded otherwise to the detergents mentioned at the beginning in their composition, but of which the builder component contained zeolite Na-A instead of sodium carbonate and sodium hydrogen carbonate, were also produced for comparison. In order to determine washing performance, white cotton fabrics soiled with standardized test soils (A: blood/milk/ink; B: blood/milk/carbon black; C: cocoa with milk) were washed in a domestic washing machine (Miele® W 701) at 40° C. (detergent dose 76 g; water hardness 17°d; load 3.5 kg, short program). The fabrics were dried and measured with a Minolta CR 200. The washing results (Y values) set out in Table 2 were obtained for the detergent containing soluble builder component. The comparison detergents containing water-insoluble builder showed inferior performance. The superior washing performance of the detergents containing sodium percarbonate coated with alkali metal silicate can be seen in the removal of soils which are removable with enzyme assistance.

TABLE 2

| Detergent containing/ soil | washing results Q30 | Q35 | PC1 | PC2 | PC3 |
|---|---|---|---|---|---|
| A | 36.2 | 37.8 | 40.9 | 40.9 | 42.5 |
| B | 42.0 | 41.7 | 46.1 | 46.8 | 50.2 |
| C | 80.7 | 79.4 | 81.6 | 83.0 | 81.6 |

What is claimed is:

1. A particulate detergent or cleaning composition, comprising as the only builder component (A) a phosphate free water-soluble builder component, wherein the water-soluble builder component comprises:

a) 5% by weight to 35% by weight citric acid, alkali metal citrate, alkali metal carbonate, alkali metal hydrogen carbonate, or any mixture thereof;

b) 1% to 5% by weight alkali metal silicate with a modulus of 1.8 to 2.5;

c) up to 2% by weight phosphonic acid and/or alkali metal phosphonate; and d) up to 10% by weight polymeric polycarboxylate and (B) alkali metal percarbonate particles that comprise at least two coating layers, an innermost layer consisting essentially of alkali metal sulfate, which may also be partly present in hydrated form and an outer layer containing alkali metal silicate, wherein this outer layer makes up 0.2% by weight to less than 1% by weight of the coated particle.

2. The composition of claim 1 wherein the innermost layer makes up 2% by weight to 20% by weight of the coated particles.

3. The composition of claim 1 wherein the layer comprising alkali metal silicate makes up 0.3% by weight to less than 1% by weight of the coated particle.

4. The composition of claim 1, wherein the alkali metal silicate in the coating layer has a modulus of >2.5.

5. The composition of claim 4, wherein the alkali metal silicate in the coating layer has a modulus of 3 to 5.

6. The composition of claim 1, comprising 6% by weight to 30% by weight of alkali metal percarbonate particles.

7. The composition of claim 6, comprising 10% by weight to 25% by weight of alkali metal percarbonate particles.

8. The composition of claim 1, comprising at least 15% by weight of the builder component.

9. The composition of claim 8, comprising 15% by weight to 55% by weight of the builder component.

10. The composition of claim 9, comprising 25% by weight to 50% by weight of the builder component.

11. The composition of claim 1, wherein the water-soluble builder component (A) comprises:

a) 5% by weight to 35% by weight citric acid, alkali metal citrate, alkali metal carbonate, alkali metal hydrogen carbonate, or any mixture thereof;

b) 1% to 5% by weight alkali metal silicate with a modulus of 1.8 to 2.5;

c) 0.05 to 1% by weight phosphonic acid and/or alkali metal phosphonate; and d) up to 10% by weight polymeric polycarboxylate.

12. The composition of claim 11, wherein the builder component comprises as component d) 1.5% by weight to 5% by weight of polymeric polycarboxylate.

13. The composition of claim 11, comprising as component a) 15% by weight to 25% by weight alkali metal carbonate alone or combined with alkali metal hydrogen carbonate, and up to 5% by weight citric acid and/or alkali metal citrate.

14. The composition of claim 13, wherein a) comprises 0.5% to 2.5% by weight of citric acid and/or alkali metal citrate.

15. The composition of claim 11, comprising as component a) 5% by weight to 25% by weight citric acid and/or alkali metal citrate and up to 5% by weight alkali metal carbonate alone or combined at least in part with alkali metal hydrogen carbonate.

16. The composition of claim 15, comprising as component a) 5% by weight to 15% by weight citric acid and/or alkali metal citrate and up to 5% by weight alkali metal carbonate alone or combined at least in part with alkali metal hydrogen carbonate.

17. The composition of claim 11, wherein component a) contains alkali metal carbonate and alkali metal hydrogen carbonate in a ratio by weight of 10:1 to 1:1.

18. The composition of claim 11, wherein component c) contains 0.05% by weight to 1% by weight phosphonic acid.

19. The composition of claim 18, wherein component c) contains 0.05% by weight hydroxy and/or aminoalkyl phosphonic acids and/or alkali metal salts thereof.

20. The composition of claim 11, wherein component d) contains 1.5% by weight to 5% by weight of polymeric selected from the group consisting of polymerization or copolymerization products of acrylic acid, methacrylic acid, or maleic acid.

21. The composition of claim 20, wherein component d) contains 1.5% by weight to 5% by weight polymerization or copolymerization products of acrylic acid, methacrylic acid and/or maleic acid.

* * * * *